US008216043B1

(12) United States Patent
Perrone et al.

(10) Patent No.: US 8,216,043 B1
(45) Date of Patent: Jul. 10, 2012

(54) SPORTS BASED INTERACTIVE WAGERING GAME WITH VARIABLE ODDS

(75) Inventors: Rick Perrone, Darien, CT (US); George Stadnik, New York, NY (US)

(73) Assignee: Tournament One, Corp., Stamford, CT (US)

( * ) Notice: Subject to any disclaimer, the term of this patent is extended or adjusted under 35 U.S.C. 154(b) by 1206 days.

(21) Appl. No.: 11/531,271

(22) Filed: Sep. 12, 2006

Related U.S. Application Data

(60) Provisional application No. 60/730,337, filed on Oct. 25, 2005, provisional application No. 60/730,348, filed on Oct. 25, 2005.

(51) Int. Cl.
*A63F 9/00* (2006.01)

(52) U.S. Cl. ..... 463/16

(58) Field of Classification Search ..... 463/16
See application file for complete search history.

(56) References Cited

U.S. PATENT DOCUMENTS

| | | | | |
|---|---|---|---|---|
| 5,782,470 | A * | 7/1998 | Langan | 273/139 |
| 6,102,797 | A * | 8/2000 | Kail | 463/16 |
| 6,296,250 | B1 * | 10/2001 | Langan | 273/139 |
| 2002/0068633 | A1 * | 6/2002 | Schlaifer | 463/43 |
| 2002/0198052 | A1 * | 12/2002 | Soltys et al. | 463/42 |
| 2003/0040358 | A1 * | 2/2003 | Rothkranz et al. | 463/20 |
| 2003/0199315 | A1 * | 10/2003 | Downes P.E. | 463/28 |
| 2005/0070351 | A1 * | 3/2005 | Reeves | 463/16 |
| 2006/0019742 | A1 * | 1/2006 | Reeves | 463/25 |
| 2006/0094490 | A1 * | 5/2006 | Reeves | 463/16 |
| 2006/0287094 | A1 * | 12/2006 | Mahaffey et al. | 463/42 |
| 2008/0113816 | A1 * | 5/2008 | Mahaffey et al. | 463/42 |
| 2008/0207310 | A1 * | 8/2008 | Mindes | 463/25 |
| 2008/0242386 | A1 * | 10/2008 | Okada | 463/3 |
| 2010/0069144 | A1 * | 3/2010 | Curtis et al. | 463/25 |
| 2010/0105464 | A1 * | 4/2010 | Storm et al. | 463/20 |
| 2010/0160012 | A1 * | 6/2010 | Amaitis et al. | 463/2 |
| 2010/0259005 | A1 * | 10/2010 | Simon | 273/292 |

OTHER PUBLICATIONS

Sportbet. Sep. 2005. < http://web.archive.org/web/20050908071152/http://www.sportbet.com/articles/baseball-betting-rules.html>.*

* cited by examiner

*Primary Examiner* — Melba Bumgarner
*Assistant Examiner* — Seng H Lim
(74) *Attorney, Agent, or Firm* — Muskin & Cusick LLC

(57) ABSTRACT

An interactive wagering game wherein a player can interact with and view a sports situation and place a wager on which of several potential outcomes a result of the situation will be. The sports situation can for example be a golfer with a ball in a sandtrap and potential results can be whether the golfer will succeed in getting the ball out of the sandtrap or not. The payout of each wager can be variable based on, for example, the difficulty or likelihood of achieving that result from the ball's current position and/or lie.

10 Claims, 5 Drawing Sheets

SPORTS BASED INTERACTIVE WAGERING GAME WITH VARIABLE ODDS

CROSS REFERENCE TO RELATED APPLICATIONS

This application claims benefit to provisional application No. 60/730,337, filed on Oct. 25, 2005, which is incorporated by reference herein in its entirety. This application also claims benefit to provisional application No. 60/730,348, which is incorporated by reference herein in its entirety.

BACKGROUND OF THE INVENTION

1. Field of the Invention

The present invention is directed to an interactive wagering type game that displays a sports situation to a player and allows the player to choose and wager on potential outcomes.

2. Description of the Related Art

Wagering games are a huge industry throughout the world. A very popular form of wagering game is a slot machine, wherein a player places a wager to spin reels in which particular combinations can pay respective awards. Some players may find it boring and repetitive to continuously sit in front of a slot machine watching spinning reels.

Therefore, what is needed is a more exciting way in which a player can place a simple wager and view its outcome.

SUMMARY OF THE INVENTION

It is an aspect of the present invention to provide an interactive wagering game that can be exciting to players.

The above aspects can be obtained by a method that includes (a) outputting a sports situation to a player; (b) outputting multiple potential outcomes of the sports situations and payouts for each respective outcome; (c) receiving a wager comprising selected outcome of the multiple outcomes and a respective wager amount; (d) determining an ultimate outcome of the sports situation; and (e) resolving the wager based on the ultimate outcome.

The above aspects can also be obtained by a computer readable storage to control a computer to perform (a) outputting a sports situation to a player; (b) outputting multiple potential outcomes of the sports situations and payouts for each respective outcome; (c) receiving a wager comprising selected outcome of the multiple outcomes and a respective wager amount; (d) determining an ultimate outcome of the sports situation; and (e) resolving the wager based on the ultimate outcome.

The above aspects can also be obtained by an apparatus that includes (a) an output device outputting a sports situation to a player and outputting multiple potential outcomes of the sports situations and payouts for each respective outcome; (b) a receiving unit receiving a wager comprising selected outcome of the multiple outcomes and a respective wager amount; and (c) a determining unit determining an ultimate outcome of the sports situation and resolving the wager based on the ultimate outcome.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
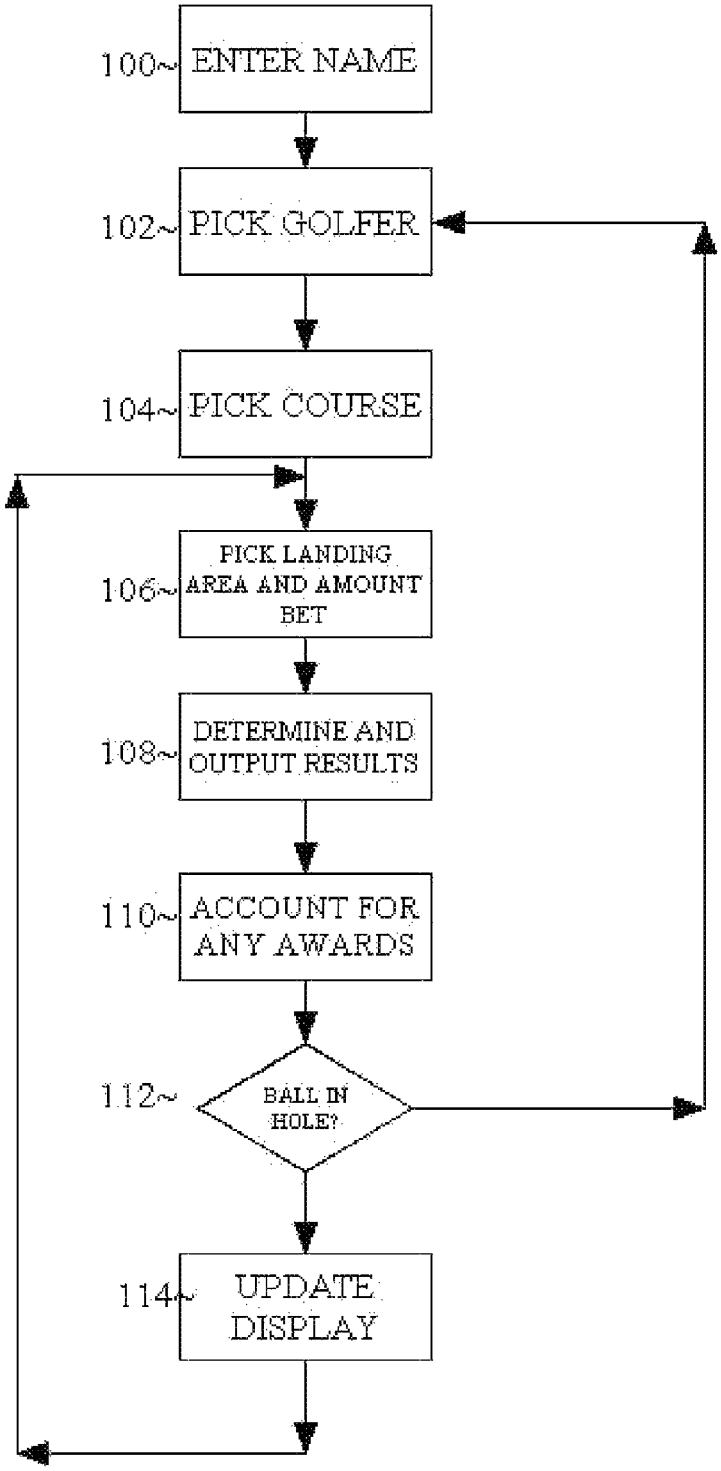
FIG. 1 is a flowchart illustrating an exemplary method of implementing an interactive wagering game, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage to implement an interactive wagering game that can present the player with sports situations. A sports situation can be a situation in a sporting event that can have multiple outcomes. For example, a golfer about to swing at a golf ball is a sports situation in that there are multiple outcomes. The player can wager on which of the multiple outcomes will result. Multiple outcomes can have different odds associated with them to reflect, for example the ease or difficulty of achieving the outcome (for example see Table I). This can provide a more entertaining and enriching experience than the typical slot machines that predominate the gambling industry.

FIG. 1 is a flowchart illustrating an exemplary method of implementing an interactive wagering game, according to an embodiment.

The method can begin with operation 100, wherein the player can input his or her name and any other identifying information requested.

The method can continue to operation 102, wherein the player can pick a particular golfer. The player can be presented with a plurality of golfers, each may have particular statistics which may, affect their performance. For example, a particular player may have an average drive of 250 yards, which could be made to hold true in play of the game. Alternatively, the choice of golfer can (or alternatively will not) have an effect on any event outcomes.

From operation 102, the method can proceed to operation 104, wherein the player can pick a course to play from a multiple of courses.

From operation 104, the method can proceed to operation 106, wherein the player is presented with a golfing situation and the player can choose a landing area from a choice of potential landing areas. If the player's choice and outcome match, then the player can win a wager. The player can also choose an amount to bet. For example, if the player is in a sand trap near the hole, potential landing areas may be: in the sand trap (if the player fails to get out), or on the green. The payout for each outcome can reflect the difficulty of achieving each outcome.

From operation 106, the method can proceed to operation 108, which determines and outputs the results. The determination can be performed as shown in the art. Random numbers can be used to generate shot characteristics (e.g. strength, direction, etc) and this can determine the trajectory of the ball. The true ideal shot characteristics can be determined and then a random error can be attributed to the ideal shot characteristics so that the ball will generally play in the proper direction but not perfectly. For example, the ideal strength (can for example be a number from 0 to 10) can be reduced/increased at random from −20% to 20%.

From operation 108, the method can proceed to operation 110, which accounts for any awards. If the player made the correct choice of outcome, then the player wins his wager at whatever odds that particular outcome was paying. Each choice (outcome) presented to the player can have different payouts on the respective wager which determine the final payment amount (see for example, Table I). The player's money is typically deducted upon making any wager, so if the player's choice does not match the outcome, the player has lost but has typically already paid.

From operation 110, the method can proceed to operation 112, which determines if the ball is in the hole (and hence the hole is complete). If the ball is in the hole, then the method can proceed to operation 102, wherein the player can pick another golfer and course. Alternatively, the method can also proceed to operation 104 or 106 as well to be presented with a new situation.

If operation 112 determines that the ball is not in the hole, then the method can proceed to operation 114, which updates the display. The new player position is displayed, along with new potential outcomes and payouts. The method can then proceed to operation 106 where the player can make additional wagers.

In addition to betting on a landing area, other more detailed proposition wagers can be made as well.

Figure 2:
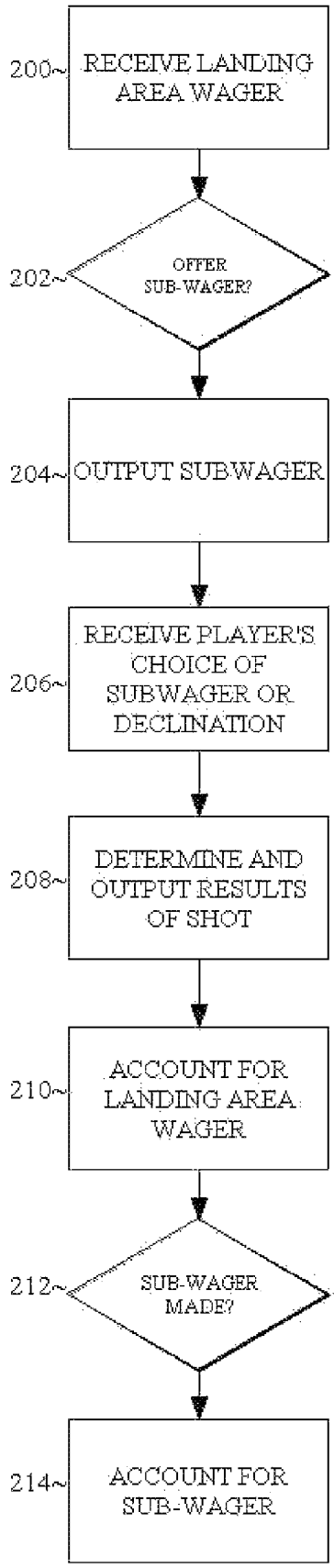
FIG. 2 is a flowchart illustrating an exemplary method of implementing additional proposition wagers, according to an embodiment.

FIG. 2 is a flowchart illustrating an exemplary method of implementing additional proposition wagers, according to an embodiment.

The method can begin with operation 200, which receives a landing area wager. This is similar to operation 106 from FIG. 1.

From operation 200, the method can proceed to operation 202, which determines whether to offer a sub-wager. A sub-wager is a wager that may be presented based on the situation as in operation 106. A table can be maintained of main wagers and potential sub-wagers (if they are to be offered). Offering sub-wagers can also be optional.

From operation 202, the method can proceed to operation 204, which outputs the particular sub-wager. For example, if the player is hitting off the tee and the player selects that the ball will land on the fairway, then a sub-wager can come up wherein the player will be presented with a choice of how many yards the ball will travel (e.g. less than 100 yards, 100-200 yards, over 300 yards. Whether the player wishes to make the sub wager is optional at the player's discretion.

From operation 204, the method can proceed to operation 206, which receives the player's choice of sub-wager. The player may also choose not to make the sub-wager. If the player wishes to make the sub-wager, the player can select or enter the particular outcome (e.g. "100-200 yards") and select or enter how much he or she wishes to bet.

From operation 206, the method proceeds to operation 208, which determines and outputs the result of the shot.

From operation 208, the method can proceed to operation 210, which accounts for the landing area wager made. For example, if the player bet that the ball would land on the fairway and the ball did not land on the fairway, then the player's choice was not matched by the game and the player has lost the wager. If the player bet that the ball would land on the fairway and it did land on the fairway, then the player's choice matched the outcome and the player has won the landing area wager.

From operation 210, the method can proceed to operation 212, which determines whether a sub-wager has been made.

If the sub-wager has been made, then the method can proceed to operation 214, which accounts for the sub-wager. For example, if the player bet that the ball would go 100-200 yards but the ball actually went less than 100 yards, then the player has lost the sub-wager. If the player has chosen the original landing area wager incorrectly, then the player will typically automatically lose his or her sub-wager.

Figure 3A:
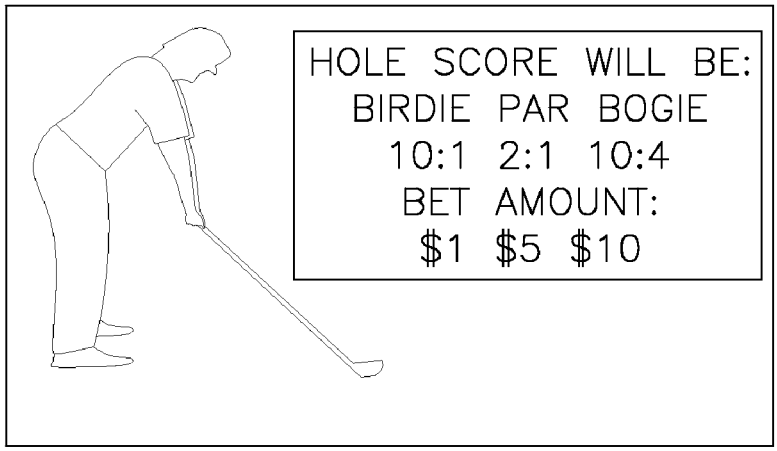
FIG. 3A is an exemplary output of a first type of proposition wager, according to an embodiment.

FIG. 3A is an exemplary output of a first type of proposition wager, according to an embodiment.

The player is starting a new hole and thus can be presented with a wager on how many strokes it will take him to complete the hole. The player can click "birdie," "par", or "bogie" as to his prediction and select or enter his bet amount. Also, the payouts for each choice can be displayed. The player may be required to make this wager (alternatively he may not be), and all other wagers after the initial overall outcome wager can be optional and can be made at the discretion of the player (alternatively, some or all of these wagers can be required).

Figure 3B:
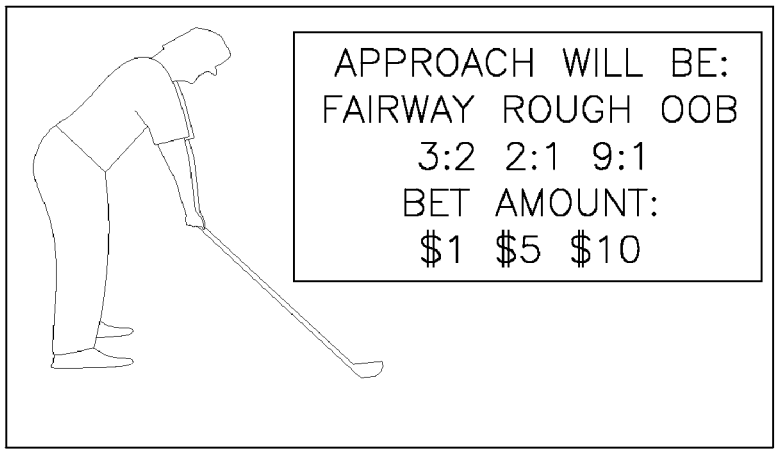
FIG. 3B is an exemplary output of a second type of proposition wager, according to an embodiment.

FIG. 3B is an exemplary output of a second type of proposition wager, according to an embodiment.

The player is taking his or her first shot for the hole and can make a wager on whether the ball will land in the fairway, the rough, or out of bounds (OOB). Respective odds for each event can also be displayed. The odds for each event can be variable, dependent, for example on the difficulty of achieving that result from the current game conditions (distance to pin, lie, etc.) The player can also choose how much to bet. The player may also be allowed (depending on the embodiment being implemented) to pass on this (or any) wager after the initial overall outcome wager.

Figure 3C:
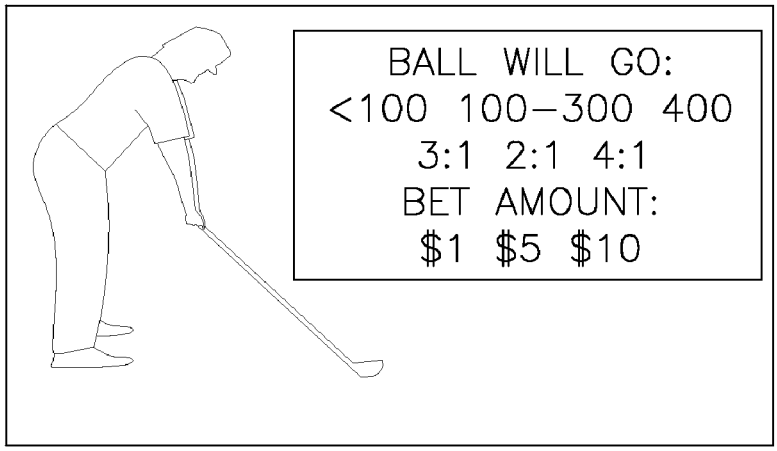
FIG. 3C is an exemplary output of a third type of proposition wager, according to an embodiment.

FIG. 3C is an exemplary output of a third type of proposition wager, according to an embodiment.

If player in FIG. 2B has selected the fairway, then the player can be presented with a further proposition of how far the ball will go. The player can bet that the ball will go less than 100 yards, 100-300 yards, or more than 300 yards (other distances and propositions can be offered as well). The player may also be given the option to decline making this proposition wager.

If the player's original landing area wager was correct, then the game can determine whether the player chose correctly for the sub-wager and can then award the player appropriately. If the player's original landing area selection is not achieved in the outcome, then the player would typically lose his or her sub-wager.

An additional sub-wager can be, for example, how many yards a putt will roll toward or past the hole.

Figure 4A:
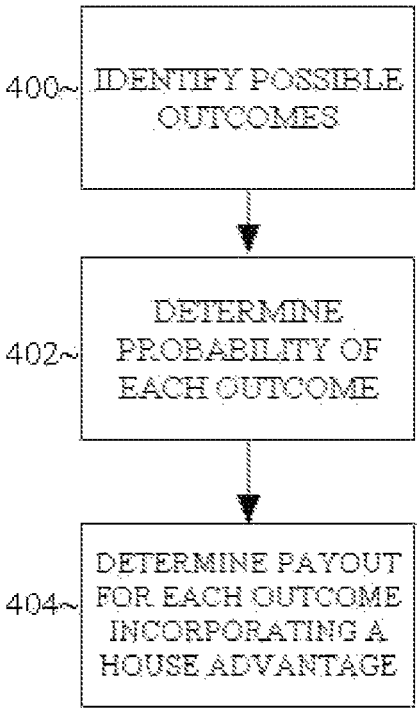
FIG. 4A is a flowchart illustrating the process of determining the payout for the wager placed, based on the outcome achieved in the event.

FIG. 4A is a flowchart illustrating an exemplary method of determining a payout for a sports situation proposition wager, according to an embodiment. FIG. 4 can be used to determine a payout for any of the wagers described herein. A standard or custom golf engine can be used to implement the game.

The method can begin with operation 400, which identifies possible outcomes. This can be done, for example, by using a table with game situations and possible outcomes. For example, the first shot on a particular hole may have outcomes of: fairway, rough, sand trap. On a different hole, the first shot may have outcomes of: fairway, rough, water. Each hole may have different landscape and thus different possibilities.

Possible outcomes can also be determined by trying different outcomes to see which ones can (or are likely to occur). For example, if the ball is in a sand trap, different resolutions can be presented to the player as wager choices.

From operation 400, the method can proceed to operation 402, which determines the probability of each outcome. This can be done using a formulaic approach using the physics model of the game being implemented. This can also be done by running a number of potential random outcomes (e.g. 100, 1,000, 100,000, etc.) and tabulating a frequency for each outcome happening. The frequency may approximate the true probability of occurrence. Probabilities can also be simply assigned by game designers as they wish.

From operation 402, the method can proceed to operation 404, which determines a payout for each outcome. This can be done based on the probability computed in operation 402. For example, if an event has a probability of 25%, then its true payout (without a house edge) would be 4:1 (player bets $1 gets $4 back if player wins). If a house edge were to be incorporated, then the return can be reduced (e.g. in the prior example the payout can be 3.5:1). Alternatively, a fixed or variable percentage can be deducted from all payouts.

As an alternative to FIG. 4A, payouts can also simply be chosen (for example arbitrarily) by a game designer and pre-stored in tables for later retrieval by the system.

Any embodiments described herein can be made available to any players through any type of interfaces, such as personal computers, kiosks, wireless devices including cellular telephones, PDA's, wireless tablets, interactive cable television, Internet protocol TV, interactive satellite television, slot machines, multi player electronic gaming tables, Video gaming machines, Video Lottery Terminals, etc.

Table I below illustrates an example hole and possible payouts at different points in the hole. The player can wager on a selected one (or optionally more than one) outcome that the player predicts (wants) to occur, and if that outcome occurs, the player wins a respective payout, and if that outcome does not occur, then the player loses the respective wager. For example, the hole can begin with the player depositing a wager and choosing whether he or she will get a birdie (pays 3:1) or a par (pays 4:1) or a bogie (pays 6:1) or other number of strokes to complete the hole (pays 6:1). The player then can hit the first shot (the drive), but before he or she does the player can place a wager on where the ball will land (fair way 1:1, sandtrap 1:1, and water hazard 1:1). If the player has selected the fairway, then the player can further select one of (100 yards, 200 yards, 300 yards) representing the distance the drive will be.

Now the player hits the ball (for example by pressing a swing button) and if the ball lands on the water hazard (although of course the random outcome could have resulted in the ball landing on the fairway or the sand trap as well), the player can then wager upon whether the next (second) shot (the approach) will result in the ball landing on the green, the rough, or the fairway. If the player selected the green, then the player can also make an optional sub wager of the distance the ball will travel (e.g. 5 yards, 10 yards, or 20 yards). If on the second shot the ball did not land on the water hazard, then the player can choose one (or more) of the following outcomes: on green, rough, fairway, hole. If the player selects on green, then the player can also place a sub wager on the length of the shot: five yards, ten yards, or twenty yards.

The player can then make a third shot (chip), and like the other shots, pick one (or optionally more than one) outcome to wager on. The player can choose: on green, in hole, past green. If the player chooses on green, then the player can also make an optional sub wager on the distance the chip will go (e.g. 5 yards, 10 yards, 20 yards).

The player can then make the next shot (putt) and select an outcome: front of hole, in hole, past hole. If the outcome is not in the hole, then the player can continue with another putt shot. The odds on the next putt shot may be the same as the initial one or they may change, depending on the shot conditions (such as distance to hole).

The appropriate outcomes/odds will typically be displayed when the player is taking the shot that those outcomes can be wagered on by the player. Of course, the outcomes and payouts in Table I are just for exemplary purposes, and other outcomes/payouts can be used as well. Further, note that different payouts for each circumstance can be used, for example, on the drive, another payout table could be (fairway 1:1, sand trap 2; 1, water hazard 5:1), wherein the payouts (with or without a house advantage) typically reflect (although not required to) the probabilities of the ball landing in each of these areas from the current position/lie of the ball (e.g. the fairway being the easiest).

TABLE I

| Variable Odds Example for Par 4 Course Overall, and Sub-Wagers |
|---|
| Initial Wager |
| Birdie - 3:1 |
| Par - 4:1 |
| Bogie - 6:1 |
| Other - 6:1 |
| Drive |
| Wager |
| Fair way - 1:1 |
| Sand Trap - 1:1 |
| Water Hazard - 1:1 |
| Sub Wager - If fairway is selected |
| 100 Yrds - 8:1 |
| 200 Yrds - 8:1 |
| 300 Yrds - 8:1 |
| Approach - Water Hazard |
| Wager |
| On Green - 1:1 |
| Rough - 1:1 |
| Fairway - 1:1 |
| Sub Wager - If on green is selected |
| 5 Yards - 10:1 |
| 10 Yards - 10:1 |
| 20 Yards -10:1 |
| Approach - Not Water Hazard |
| Wager |
| On Green - 1:1 |
| Rough - 1:1 |
| Fairway - 1:1 |
| In Hole - 1:1 |
| Sub Wager - If on green is selected |
| 5 Yards - 10:1 |
| 10 Yards - 10:1 |
| 20 Yards - 10:1 |
| Chip |
| Wager |
| On Green - 1:1 |
| In Hole - 1:1 |
| Past Green - 1:1 |
| Sub Wager - If on green is selected |
| 5 Yards - 1:8 |
| 10 Yards - 1:8 |
| 20 Yards - 1:8 |

TABLE I-continued

| Variable Odds Example for Par 4 Course Overall, and Sub-Wagers |
|---|
| Putt |
| Wager |
| Front of Hole - 1:1 |
| In Hole - 1:1 |
| Past Hole - 1:1 |

Thus, an example of an entire game according to Table I is as follows. A player places an initial $1 wager that his result will be a birdie. The player then places a $2 wager that his drive will be in the sand trap. The player then hits, and the ball lands in the sand trap. The player wins $2 (1:1 payout). The player then wagers $3 that the next shot (from the sand trap) will land on the green. The player is then presented with a menu of sub-wagers showing the distance that the ball will travel, and the player wagers $4 that the ball will travel five yards. The player then shoots and the ball travels ten yards and lands on the green. The player thus wins $3 since the ball landed on the green but loses the $4 sub wager, since the ball did not travel five yards. The player then declines to make a further wager and just hits the ball, which lands into the hole. Since the par of the hole is four, and the player made it into the hole in three strokes, then the player achieved a birdie and thus wins $9 on the initial wager.

Figure 5A:
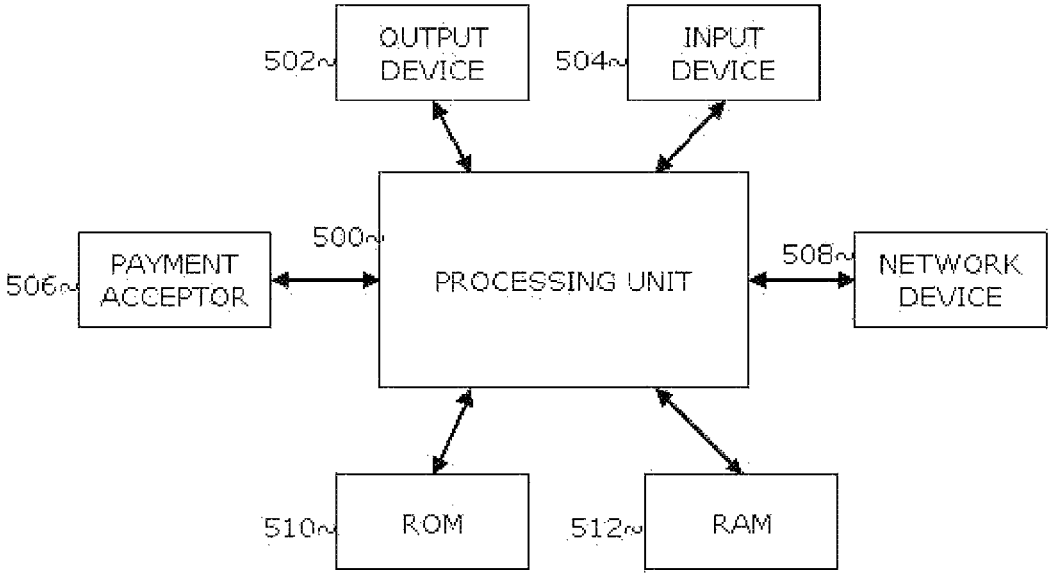
FIG. 5A is a block diagram illustrating exemplary hardware that can be used to implement an embodiment.

FIG. 5A is a block diagram illustrating exemplary hardware that can be used to implement an embodiment.

A processing unit 500 can be connected to an output device 502 (such as a CRT, etc.), an input device 504 (such as a keyboard, buttons, etc.), a payment acceptor 506 (which can accept cash purchases), a network device 508 (which can connect the unit to other devices), a ROM 510, and a RAM 512.

Figure 5B:
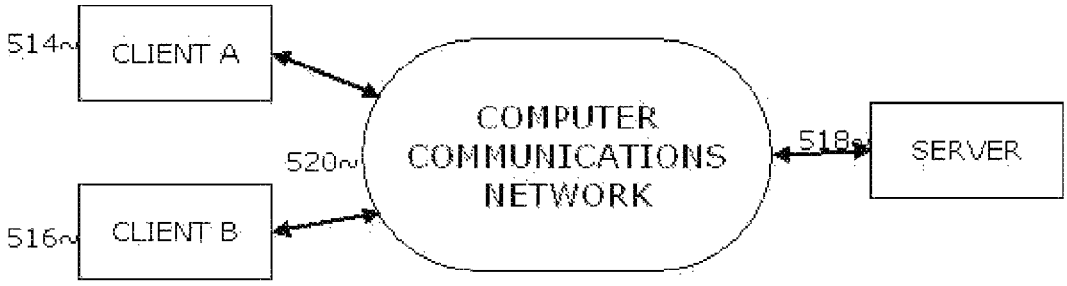
FIG. 5B is a block diagram illustrating exemplary hardware that can be used to implement a networked embodiment of an interactive wagering game.

FIG. 5B is a block diagram illustrating exemplary hardware that can be used to implement a networked embodiment of a wagering game.

Embodiments described herein can be served over the Internet so players can play remotely for fun, points and credits that are convertible to prizes, or real money.

A server 518 can be used to host and serve a game to multiples clients, such as client A 514 and client B 516 using a computer communications network 520 (such as the Internet).

It is noted that any of the operations described herein can be performed in any sensible order. Further, any operations may be optional. Also, any feature or embodiment described herein can be combined with any other.

The many features and advantages of the invention are apparent in the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play an interactive wagering game, the method comprising:

executing instructions on a processor on a machine to perform the following operations:

outputting a particular sports situation to a player on an output device associated with the machine;

outputting a set of potential outcomes for the sports situations and payouts for each respective outcome, the set of potential outcomes being determined based on the particular sports situation;

receiving, from the player, a main wager comprising a player selected outcome out of the set of potential outcomes and a wager amount;

outputting to the player a respective set of sub-wagers, the respective set of sub-wagers determined based on the player selected outcome;

allowing the player to place a side wager on a player chosen sub-wager out of the respective set of sub-wagers;

wherein each outcome in the set of potential outcomes is associated with a respective set of sub-wagers; and determining and outputting on the output device an ultimate outcome and a sub-outcome of the sports situation, the ultimate outcome being picked out of the set of potential outcomes based on a random factor and the sub-outcome being picked out of the set of sub-wagers, wherein if the ultimate outcome matches the player selected outcome and if the chosen sub-wager matches the sub-outcome then awarding the player a first award based on the main wager and a second award based on the side-wager, wherein if the ultimate outcome matches the player selected outcome and if the chosen sub-wager does not match the sub-outcome then awarding the player a first award based on the main wager and the player loses the side-wager, wherein if the ultimate outcome does not match the player selected outcome then the players loses the main wager and automatically loses the side-wager.

2. A method as recited in claim 1, wherein the sports situation is a shot in a golf game.

3. A method as recited in claim 2, further comprising:

at a beginning of a hole, offering the player a proposition wager based on a final score for the hole.

4. A method as recited in claim 1, wherein the sports situation is a shot in a golf game and the sub-wager is a distance a ball will be from a reference point.

5. A method as recited in claim 2, wherein the player can select a particular animated golfer character as the golfer that plays the game.

6. A method as recited in claim 2, wherein the player can select a particular course.

7. A method as recited in claim 1, wherein the payouts are variable depending on the sports situation.

8. A method as recited in claim 1, further comprising:

after the determining and outputting, outputting multiple further outcomes of the sports situations and payouts for each respective further outcome, the further outcomes are all possible results of continued play from the ultimate outcome, the payouts reflecting probabilities of achieving each respective further outcome, receiving a further wager comprising a selected further outcome out of the multiple further outcomes and a respective wager amount;

determining an ultimate further outcome of the sports situation; and resolving the further wager based on the ultimate outcome.

9. A non-transitive computer readable storage medium storing a computer program to control a computer to perform:

executing instructions on a processor on a machine to perform the following operations:

outputting a particular sports situation to a player on an output device associated with the machine;

outputting a set of potential outcomes for the sports situations and payouts for each respective outcome, the set of potential outcomes being determined based on the particular sports situation;

receiving, from the player, a main wager comprising a player selected outcome out of the set of potential outcomes and a wager amount;

outputting to the player a respective set of sub-wagers, the respective set of sub-wagers determined based on the player selected outcome;

allowing the player to place a side wager on a player chosen sub-wager out of the respective set of sub-wagers;

wherein each outcome in the set of potential outcomes is associated with a respective set of sub-wagers; and determining and outputting on the output device an ultimate outcome and a sub-outcome of the sports situation, the ultimate outcome being picked out of the set of potential outcomes based on a random factor and the sub-outcome being picked out of the set of sub-wagers, wherein if the ultimate outcome matches the player selected outcome and if the chosen sub-wager matches the sub-outcome then awarding the player a first award based on the main wager and a second award based on the side-wager, wherein if the ultimate outcome matches the player selected outcome and if the chosen sub-wager does not match the sub-outcome then awarding the player a first award based on the main wager and the player loses the side-wager, wherein if the ultimate outcome does not match the player selected outcome then the players loses the main wager and automatically loses the side-wager.

10. An apparatus to implement a wagering game, the apparatus comprising:

an input device;

an output device;

a processing unit adapted to operate with the input device and the output device, the processing unit configured to perform:

outputting a particular sports situation to a player on the output device;

outputting a set of potential outcomes for the sports situations and payouts for each respective outcome, the set of potential outcomes being determined based on the particular sports situation;

receiving, from the player, a main wager comprising a player selected outcome out of the set of potential outcomes and a wager amount;

outputting to the player a respective set of sub-wagers, the respective set of sub-wagers determined based on the player selected outcome;

allowing the player to place a side wager on a player chosen sub-wager out of the respective set of sub-wagers;

wherein each outcome in the set of potential outcomes is associated with a respective set of sub-wagers; and determining and outputting on the output device an ultimate outcome and a sub-outcome of the sports situation, the ultimate outcome being picked out of the set of potential outcomes based on a random factor and the sub-outcome being picked out of the set of sub-wagers, wherein if the ultimate outcome matches the player selected outcome and if the chosen sub-wager matches the sub-outcome then awarding the player a first award based on the main wager and a second award based on the side-wager, wherein if the ultimate outcome matches the player selected outcome and if the chosen sub-wager does not match the sub-outcome then awarding the player a first award based on the main wager and the player loses the side-wager, wherein if the ultimate outcome does not match the player selected outcome then the players loses the main wager and automatically loses the side-wager.

* * * * *